United States Patent [19]

Cramer et al.

[11] Patent Number: 4,789,048

[45] Date of Patent: Dec. 6, 1988

[54] CHECKOUT COUNTER

[75] Inventors: Martin L. Cramer, Cambridge, Ohio; Mark J. Moneypenny, Eastwood, Ky.

[73] Assignee: NCR Corporation, Dayton, Ohio

[21] Appl. No.: 102,451

[22] Filed: Sep. 28, 1987

[51] Int. Cl.[4] ..... A47F 19/04

[52] U.S. Cl. ..... 186/61; 108/6; 108/9; 312/140.1

[58] Field of Search ..... 186/52, 59, 61–69; 108/6, 9, 92; 312/140.1, 140.3, 140.4, 281, 282, 313, 314; 235/454, 462, 383, 385

[56] References Cited

U.S. PATENT DOCUMENTS

| | | | |
|---|---|---|---|
| 2,522,296 | 9/1950 | Overstedt | 108/9 |
| 2,563,658 | 8/1951 | Novy | 108/9 |
| 2,964,134 | 12/1960 | Bisen | 186/59 |
| 3,557,907 | 1/1971 | Close | 186/62 |
| 3,606,450 | 9/1971 | Sedgwick | 108/6 X |
| 3,656,587 | 4/1972 | Siegel | 186/66 |
| 3,960,420 | 6/1976 | Speraw et al. | 186/66 X |
| 4,020,924 | 5/1977 | Conrotto et al. | 186/61 |
| 4,138,000 | 2/1979 | Hartup | 186/61 |
| 4,180,158 | 12/1979 | Frederick | 186/67 X |
| 4,496,200 | 1/1985 | Hagstrom et al. | 312/282 X |
| 4,550,666 | 11/1985 | Svoboda | 108/9 X |
| 4,552,362 | 11/1985 | Oake | 108/6 X |
| 4,618,032 | 10/1986 | Cramer | 186/61 |
| 4,619,427 | 10/1986 | Leymann | 108/92 X |

*Primary Examiner*—Kevin P. Shaver

*Attorney, Agent, or Firm*—Wilbert Hawk, Jr.; Albert L. Sessler, Jr.; Richard W. Lavin

[57] ABSTRACT

A checkout counter having a portion of the counter surface tilted in a direction facing the operator in which surface portion is mounted an optical scanner. The tilted counter surface portion also includes an adjacent supporting surface for a keyboard member. The remaining portion of the counter surface supports a check endorsement stand and a support member for supporting a customer display or a printing mechanism. Located adjacent the tilted counter surface are shelves for supporting cash and media drawers and doors enclosing a number of secure storage areas for storing electronic devices and other associated modules. A second embodiment is disclosed in which the tilted countertop portion is rotatably mounted to position the optical scanner at an angle to a horizontal plane in accordance with the checkout operator's preference.

8 Claims, 3 Drawing Sheets

CHECKOUT COUNTER

BACKGROUND OF THE INVENTION

The present invention relates to checkout counters and more particularly to a checkout counter which incorporates an optical reader for reading coded labels and automatically inserting the generated information into a POS (point of sale) electronic cash register or a data terminal device. This arrangement requires the operator, during the checkout operation, to merely move each purchased merchandise item past the optical reader without attending to the POS terminal device, thereby measurably increasing the speed of the checkout operation.

A new concept in merchandising is that of the warehouse supermarket in which the customer loads a shopping cart with items purchased from the warehouse shelves. A checkout operator, in processing the purchased merchandise items, will remove the items from the shopping cart positioned adjacent the operator by the purchaser, will index a code number identifying the item into a terminal device and after the price has been displayed and printed, will place the purchased merchandise item in a second shopping cart also located adjacent the operator. This type of checkout operation does not require a flat counter top on which a merchandise items are positioned prior to a checkout operation. Present checkout counters employed in this type of merchandising operation have been limited to a support stand for the data terminal device in which the checkout operator reads an item identifying code printed on a label attached to the purchased merchandise item and indexing such code number into the terminal device. As a result of this arrangement, the speed of the checkout operation is relatively slow.

It is therefore a principal object of this invention to provide a checkout counter which will increase the checkout operation of merchandise items in which the purchased merchandise items are removed and processed directly from a shopping cart.

It is a further object of this invention to provide a checkout counter which includes an optical scanner for scanning purchased merchandise items which are moved past the scanner when the items are removed directly from a shopping cart.

It is another object of this invention to provide a checkout counter which is simple in construction and therefore low in cost.

SUMMARY OF THE INVENTION

In order to fulfill these objects, there is provided a checkout counter which includes an optical scanner mounted within a portion of the counter tilted at an angle facing the checkout operator. The counter also includes an adjustable keyboard stand, a customer check endorsement stand, a number of secure storage areas for processors and other associated electronic modules and an extended shelf member for supporting a customer display or a printing mechanism. Located adjacent the optical scanner are shelves for supporting a cash drawer, a media drawer and merchandise items during a key entry operation. A second embodiment provides a checkout counter with the optical scanner rotatably mounted in the counter which allows that portion of the counter containing the scanner to be positioned at an angle to accommodate checkout operator preferences and shopping carts of various heights.

BRIEF DESCRIPTIONS OF THE DRAWINGS

Additional advantages and features of the present invention will become apparent and fully understood from a reading of the following description taken together with the annexed drawings.

DESCRIPTION OF THE PREFERRED EMBODIMENT

Figure 1:
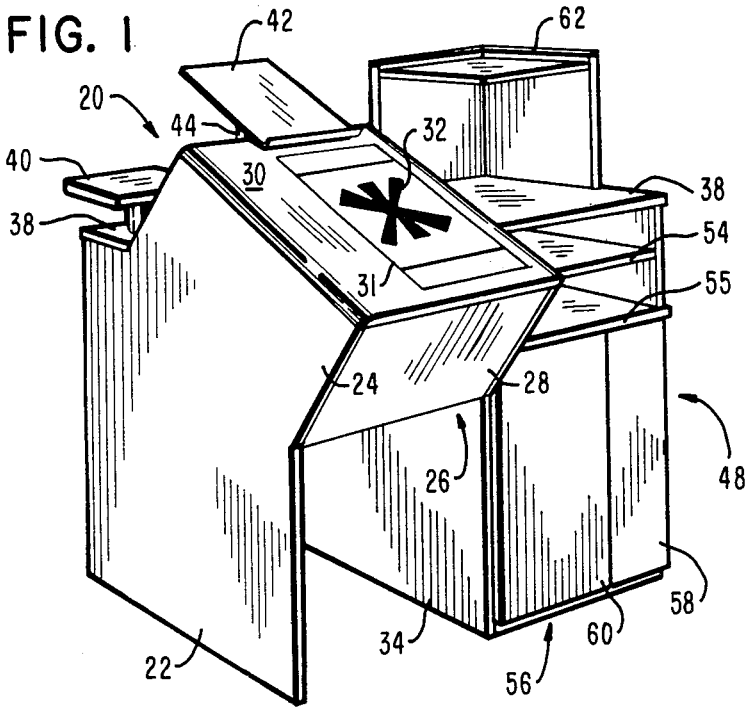
FIG. 1 is a perspective view of the checkout counter of the present invention showing the optical scanner facing the checkout operator and tilted at a thirty degree angle to a horizontal plane.
Figure 2:
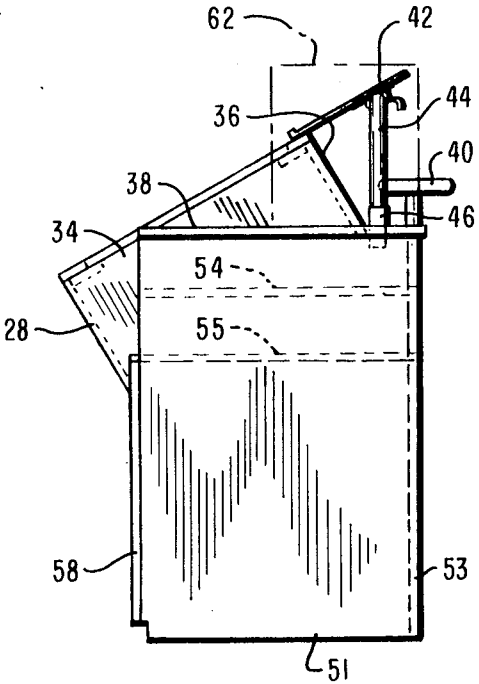
FIG. 2 is a right side view of the checkout counter of the present invention with the printer shelf member shown in phantom lines.

Referring now to the drawings, particularly FIG. 1, there is shown a perspective view of the checkout counter of the present invention which comprises a cabinet structure indicated by the reference numeral 20 which includes a left side wall portion 22 having a canted upper extension portion 24 forming one side of an enclosed optical scanner housing portion generally indicated by the numeral 26. The housing portion 26 is tilted at an acute angle of 30 degrees towards the checkout operator. The housing portion 26 includes a front wall portion 28, a top supporting surface 30 in which is located an aperture 32 associated with an optical scanner (not shown) mounted within the housing portion 26 through which scanning light beams are projected in a manner that is well known in the art. The housing portion 26 further includes a sidewall portion 34 (FIG. 2) and a rear wall portion 36. Located adjacent the rear wall portion 36 and extending towards the rear of the counter is a horizontal shelf portion 38 (FIGS. 1 and 2) on which is mounted a customer check writing stand 40. Further mounted on the shelf portion 38 by means of a pedestal member 44 is a keyboard table 42. As shown in FIG. 2, the pedestal member 44 is slidably mounted within a support member 46 enabling the keyboard table 42 to be adjusted in an upward direction. The front portion of the keyboard table 42 is normally located on the rear edge of the supporting surface 38 (FIG. 1).

Figure 3:
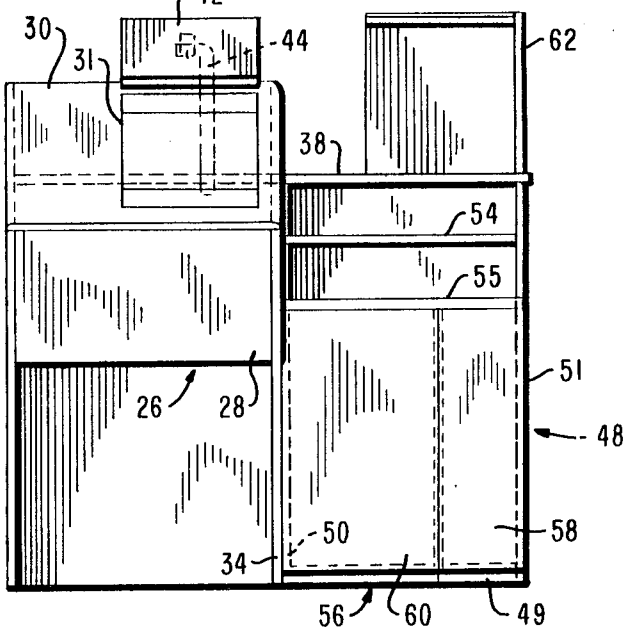
FIG. 3 is a front view of the checkout counter of the present invention.

The cabinet structure 20 also includes a side portion generally indicated by the numeral 48 (FIG. 3) which is mounted to the cabinet structure 20 in any conventional manner. The side portion 48 includes a base portion 49, side wall portions 50 and 51, the top supporting surface 38 (FIG. 1) and a pair of shelf members 54 and 55 mounted between the side wall portion 51 and the side wall portion 34 of the cabinet structure 20. The lower portion of the cabinet portion 48, generally indicated by the numeral 56, is divided into two storage areas enclosed by two door members 58 and 60. The storage area enclosed by the door 58 forms a secure area for processors and other associated point of sale electronic modules. The storage area enclosed by the door member 60 provides miscellaneous storage area. Movably positioned on the top surface 38 of the cabinet portion 48 is a support member 62 on which may be located a printer or a customer display unit.

Figure 5:
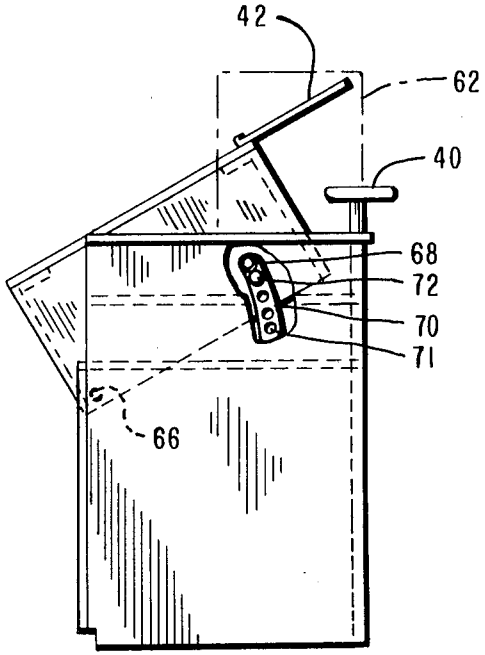
FIG. 5 is a right side view of the checkout counter of FIG. 4 showing details of the mounting of the optical scanner within the checkout counter.
Figure 4:
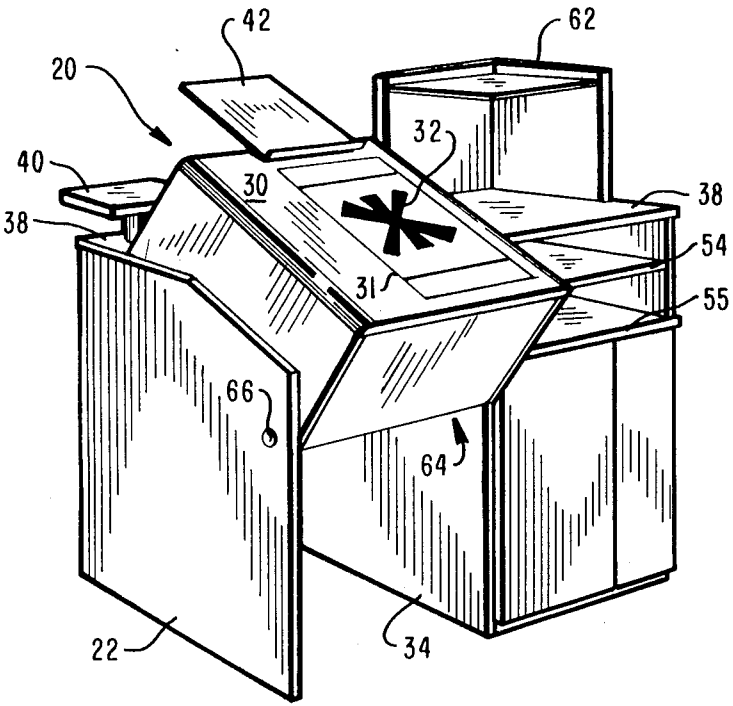
FIG. 4 is a perspective view of a second embodiment of the checkout counter of the present invention in which the optical scanner is rotatably mounted within the counter.

Referring now to FIG. 4 there is shown a second embodiment of the checkout counter of the present invention in which the optical scanner support member corresponding to the housing portion 26 (FIG. 1) forms a module indicated by the numeral 64 which is rotatably mounted within the cabinet structure 20. As best seen in FIG. 5, the module 64 is rotatably mounted on an axle member 66 which in turn is mounted between the sidewall portions 22 and 34 of the cabinet structure 20. A pair of rollers 68 mounted to the rear of the module 64 are positioned within a curved track member 70 mounted on the inside surface of the sidewall portions 22 and 34 of the cabinet structure 20. By mounting a bolt member 72 in one of the holes 71 located in the track member 70, the optical scanner module 64 can be adjusted to an angle which can accommodate an operator's preference and also shopping carts of various heights.

Figure 6:
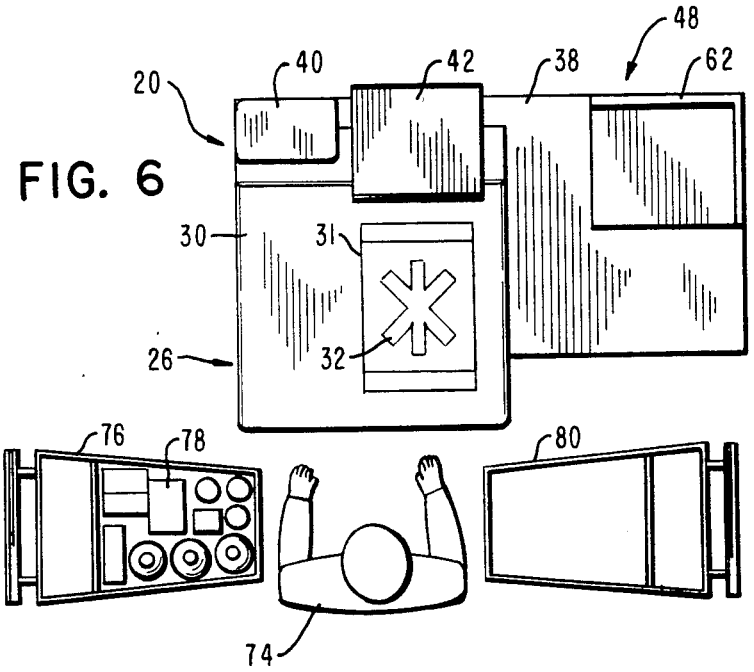
FIG. 6 is a top view of a checkout station showing the location of the counter, the checkout operator and the two shopping carts associated with the checkout operation.

Referring now to FIG. 6 there is shown a top view of a checkout station in which is located the checkout counter of the present invention. The checkout operator 74 is normally positioned adjacent the optical scanner housing portion 26 and adjacent a shopping cart 76 in which are located the purchased merchandise items 78. In checking the items 78, the operator will move the item and its attached coded label (not shown) past the aperture 32 of the optical scanner from which data is read from the coded label, and the price of the item is determined in a manner that is well known in the art. After generating a scanning operation, the operator will place the merchandise item 78 in the cart 80. After all the purchased merchandise items 78 have been scanned and placed in the cart 80, the operator will present a receipt (not shown) of the items purchased to the customer for payment. After payment, the customer will take the cart 80 and proceed to a pickup area. If a purchased merchandise item will not produce a valid scanning operation when the operator has moved the item past the optical scanner aperture 32, the operator may place the item on the supporting surface 38 while entering the item code number in a keyboard (not shown) mounted on the keyboard holder 42. After the item code number has been entered into the keyboard, and the price of the item has been displayed on a display (not shown) mounted on the support member 62, the operator will then place the item in the shopping cart 80. In paying the amount due for the purchased merchandise items, the customer may use the table 40 for writing a check.

It will be seen that the construction of the checkout counter described allows the operator to check out merchandise items which are stored in a shopping cart and which are to be stored in a second shopping cart after the checkout operation has been completed in a highly efficient manner which increases the speed of the checkout operation.

While the principles of the invention have now been made clear in an illustrated embodiment, it will be obvious to those skilled in the art that many modifications of structure, arrangements, elements and components can be made which are particularly adapted for specific environments and operating requirements without departing from these principles.

We claim:

1. In a checkout system including a checkout counter for self-service stores which have movable shopping carts for use by customers in accumulating merchandise items from different locations in the store and for transporting the purchased merchandise items to a checkout station for checking by a checkout operator, said checkout counter comprising:

a support structure including a pair of sidewall portions supporting a horizontally mounted first support member;

an intermediate sidewall portion extending from said member parallel to and between said sidewall portions;

a supporting surface extending between one of said sidewall portions and said intermediate sidewall portion, said supporting surface being inclined upwardly towards the rear of the support structure and including a front wall portion extending outwardly from the support structure and a rear wall portion engaging said first support member enabling a first shopping cart containing purchased merchandise items to be positioned adjacent one side of the front wall portion and a second shopping cart positioned adjacent the opposite side of the front wall portion for receiving the purchased merchandise items; and an optical scanning system mounted within the support structure adjacent said supporting surface including an aperture located in said supporting surface through which scanning light beams from said optical scanning system are directed for scanning a coded label on a merchandise item positioned on said supporting surface.

2. The checkout system of claim 1 in which said support structure further includes a slidably mounted second support member extending from one end of said first supporting surface overhanging said rear wall portion for supporting a keyboard member thereon.

3. The checkout system of claim 2 which further includes a check writing stand member mounted on said first support member adjacent said rear wall portion enabling a customer to write on said stand.

4. The checkout system of claim 3 further including a plurality of secure storage areas located below said first support member adjacent said intermediate sidewall portion for storing electronic processing devices associated with the checkout system.

5. A checkout counter comprising:

a support structure including first and second sidewall portions supporting a horizontally mounted first support member;

a third sidewall portion supporting said support member and located between said first and second sidewall portions, said third sidewall portion forming a recessed area in said support structure with said first sidewall portion;

a housing member positioned in said recessed area and rotatably mounted on said first and third sidewall portions, said housing member comprising fourth and fifth sidewall portions and a supporting surface positioned between said fourth and fifth sidewall portions, said supporting surface being inclined at an angle upwardly toward the rear of the support structure and including a front wall portion extending outwardly from the support structure adjacent to the location of a checkout operator and a rear wall portion positioned adjacent said first support member enabling a first shopping cart member to be containing purchased merchandise time to be positioned adjacent one side of the front wall portion and a second shopping cart member positioned adjacent the opposite side of the front wall portion between the intermediate and second sidewall portions for receiving the purchased merchandise items; and an optical scanning system mounted within the housing member adjacent said supporting surface which includes an aperture located in said supporting surface for projecting scanning light beams from said optical scanning system through said aperture for scanning a coded label on a merchandise item positioned on said supporting surface adjacent said aperture.

6. The checkout counter of claim 5 which further includes a slidably mounted second support member mounted on one end of said supporting surface overhanging said rear wall portion for supporting a keyboard device thereon.

7. The checkout counter of claim 6 in which said support structure includes a plurality of shelf members mounted between the second and third sidewall portions adjacent the housing member and a pair of door members mounted below said shelf members for enclosing a pair of secure areas within the structure for storing sensitive electronic devices.

8. The checkout counter of claim 7 which further includes adjusting means mounted between said housing member and said first and third sidewall portions for positioning the housing member at one of a plurality of acute angles to a horizontal plane parallel to said support member.

* * * * *

UNITED STATES PATENT AND TRADEMARK OFFICE

CERTIFICATE OF CORRECTION

PATENT NO. : 4,789,048

DATED : December 6, 1988

INVENTOR(S) : Martin L. Cramer et al.

It is certified that error appears in the above-identified patent and that said Letters Patent is hereby corrected as shown below:

Column 4, line 16, before the word "member" insert --support--.

Column 5, line 6, delete "time" and substitute --items--.

Signed and Sealed this

Ninth Day of May, 1989

*Attest:*

DONALD J. QUIGG

*Attesting Officer*

*Commissioner of Patents and Trademarks*